US005386710A

United States Patent [19]

Moore

[11] Patent Number: 5,386,710

[45] Date of Patent: Feb. 7, 1995

[54] FOOT JEWELRY

[76] Inventor: Alberta M. Moore, 21 Seminary Ave., Hopewell, N.J. 08525

[21] Appl. No.: 951,384

[22] Filed: Sep. 25, 1992

[51] Int. Cl.[6] ..... A44C 25/00

[52] U.S. Cl. ..... 63/2

[58] Field of Search ..... 63/2, 3, 11, 13; D11/3, D11/6, 11; 223/48

[56] References Cited

U.S. PATENT DOCUMENTS

| | | | |
|---|---|---|---|
| D. 67,909 | 7/1925 | Staub | 63/2 |
| D. 112,001 | 11/1938 | Solomon | D11/11 |
| D. 128,494 | 7/1941 | Lerner et al. | D11/11 |
| D. 145,318 | 7/1946 | Lowenst | 63/2 |
| D. 152,864 | 3/1949 | Carlson | D11/11 |
| D. 253,437 | 10/1979 | Jensen . | |
| D. 253,917 | 1/1980 | Wilkinson . | |
| D. 300,881 | 5/1989 | Dickenson . | |
| D. 309,275 | 7/1990 | Kouns | D11/11 |
| 417,569 | 12/1889 | Margileth | 63/2 |
| 1,628,278 | 5/1927 | Scheuer | 63/2 |
| 1,691,445 | 11/1928 | Meliodon | 63/15.1 |
| 2,650,590 | 9/1953 | Moore et al. | 63/2 |
| 2,840,412 | 6/1958 | Lancaster | 63/15.3 |
| 3,656,244 | 4/1972 | Andrade . | |
| 4,096,710 | 5/1978 | Sloan . | |
| 4,121,360 | 10/1978 | Vierebome | 63/2 |
| 4,406,296 | 9/1983 | Wexler et al. | 63/2 |
| 4,757,558 | 7/1988 | Strongwater | 63/2 |

*Primary Examiner*—Michael J. Milano
*Attorney, Agent, or Firm*—Ralph W. Selitto, Jr.

[57] ABSTRACT

An article of foot jewelry has at least a portion which is expandable and contractible to an extent which permits some degree of adjustability. The foot jewelry; can be provided with decorative elements, such as beads and the like, which are cushioned so as to enhance wearer comfort.

19 Claims, 2 Drawing Sheets

FOOT JEWELRY

FIELD OF THE INVENTION

The present invention relates to a piece of jewelry to be worn on the bare foot of an individual as a decorative accessory.

BACKGROUND OF THE INVENTION

Foot decorations are known which function as a decorative accessory for the bare foot of a wearer. One type of foot decoration is attached between a wearer's ankle and toe (see, for example, U.S. Pat. Nos. Des. 253,437; Des. 253,917; Des. 300,881; and 3,656,244). Another type is attached between the toes of a wearer (see U.S. Pat. No. 4,096,710).

The foot decoration disclosed in U.S. Pat. No. 3,656,244 consists of a loop portion adapted to be applied over the toe of a user, a decorative piece between the toe and the user's ankle, and an ankle wrap, in the form of cords or chains attached at one end to the decorative piece, which must be tied or otherwise fastened around the ankle. While the ankle wrap would provide limited adjustability, it is disadvantageous due to the time required to knot or otherwise fasten it. Because the knot is in direct contact with the user's skin, the ankle wrap, when in use, could also result in user discomfort. Besides detracting from the overall appearance of the foot decoration, the knot or other fastening means also inhibits the ankle wrap itself from being decorated with adornments, such as beads and the like.

U.S. Pat. No. Des. 300,881 discloses a foot decoration which includes a plurality of decorative pieces, such as beads or the like. The decorative pieces are attached to the foot decoration by fasteners which are exposed to the wearer's skin and which therefore are likely to cause discomfort to the wearer.

U.S. Pat. No. Des. 253,917 discloses a foot ornament having a toe ring which is connected to an ankle strap by another strap. While the ankle strap would provide limited adjustability as a result of its use of a buckle, the use of the buckle is disadvantageous due to the time required to engage and disengage the buckle. Because the buckle is in direct contact with a user's skin, the ankle strap could also result in user discomfort.

SUMMARY OF THE INVENTION

The present invention relates to a new and improved article of foot jewelry which normally includes first attaching means for attaching the foot jewelry to a wearer's ankle, second attaching means for attaching the foot jewelry to a wearer's toe and third attaching means for attaching the first and second attaching means to each other. In accordance with one improvement, at least one of the attaching means is elastically expandable and contractible, whereby the foot jewelry has some degree of adjustability. If all three of the attaching means are elastically expandable and contractible, the foot jewelry would be infinitely adjustable and therefore capable of fitting feet of virtually all sizes and shapes.

Another improvement involves providing the foot jewelry with at least one decorative element and cushioning means which creates a cushion between each decorative element and a wearer's foot. The creation of such a cushion permits all or a portion of the foot jewelry to be decorated with beads and the like without causing significant discomfort to the wearer.

BRIEF DESCRIPTION OF THE DRAWINGS

For a more complete understanding of the present invention, reference may be had to the following detailed description of an exemplary embodiment considered in conjunction with the accompanying drawings, in which.

DETAILED DESCRIPTION OF THE EXEMPLARY EMBODIMENT

Figure 1:
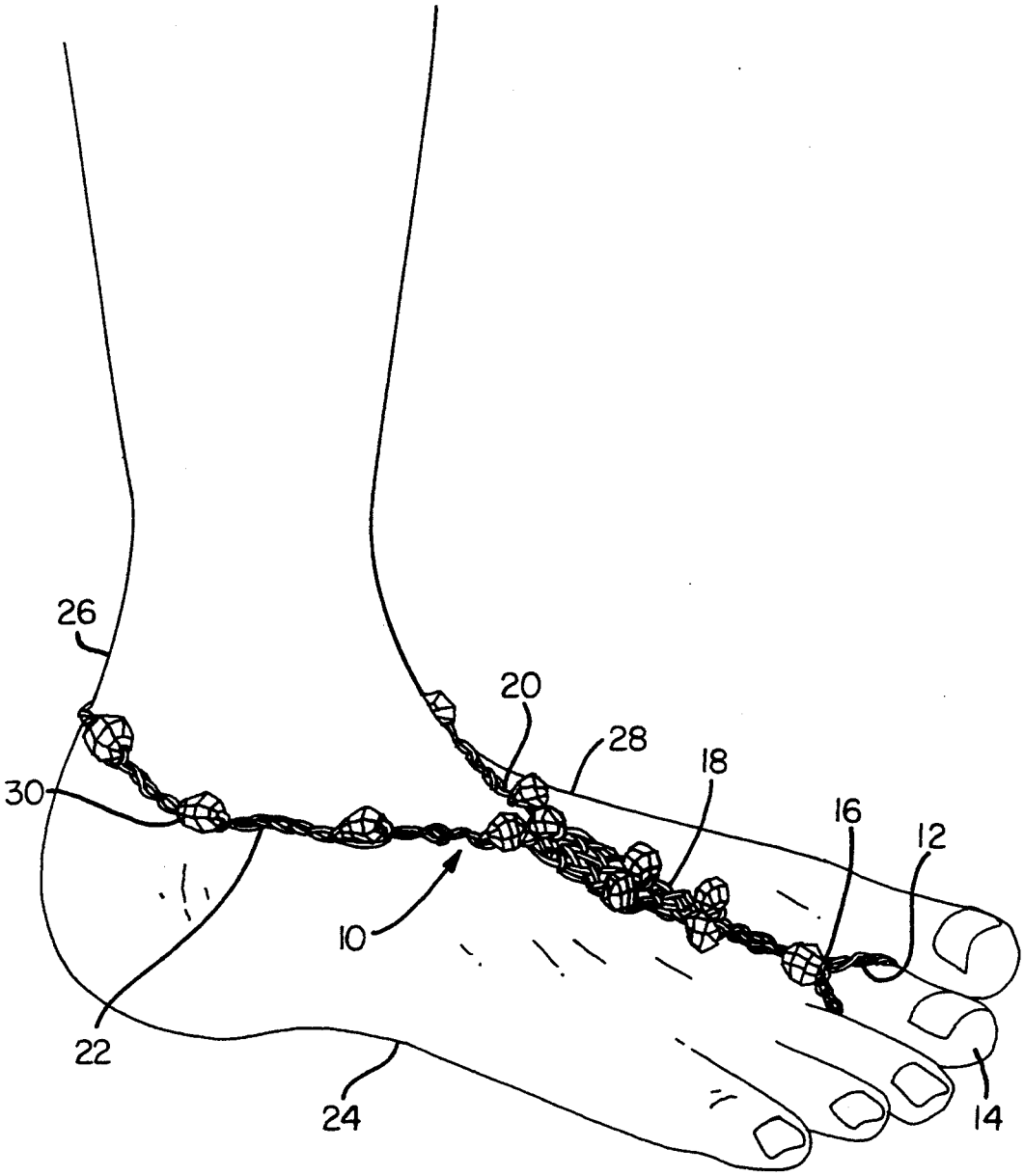
FIG. 1 is a perspective view of an article of foot jewelry constructed in accordance with one exemplary embodiment of the present invention and applied to a bare foot of a wearer.
Figure 2:
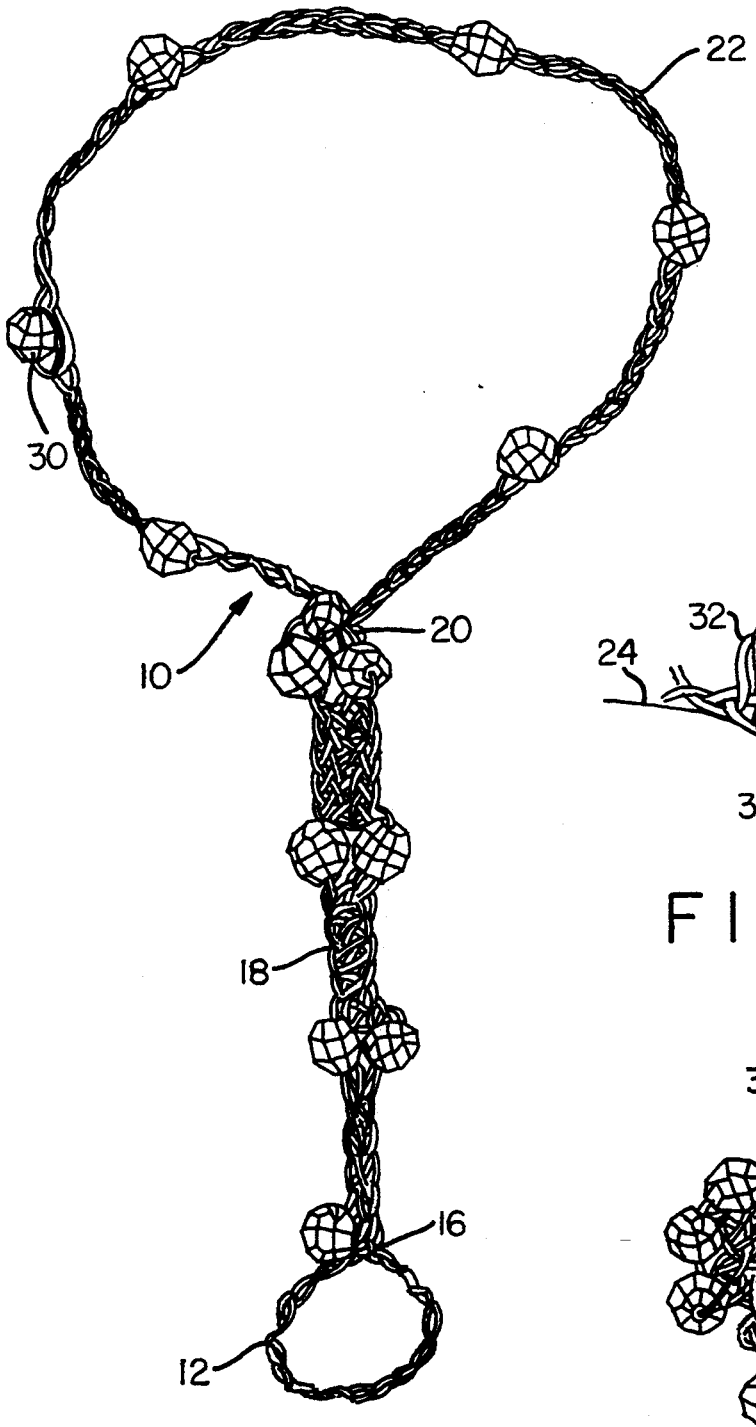
FIG. 2 is an elevational view of the foot jewelry of FIG. 1, the foot jewelry being shown in FIG. 2 in an expanded state when it is not applied to a wearer's foot.

Referring to FIGS. 1 and 2, an article of foot jewelry 10 includes a closed toe loop 12 composed of a series of loop stitches made from an elastic yarn, such as LUREX, so that the toe loop 12 can be expanded to fit over and around a toe 14 of a wearer (see FIG. 1). The toe loop 12 merges into a narrow end 16 of a connecting bridge 18, which consists of a series of ladder-type stitches made from an elastic yarn, such as LUREX. The connecting bridge 18 has a wide end 20, which branches into a series of loop stitches forming a closed ankle loop 22. Because the loop stitches which form the ankle loop 22 are made from an elastic yarn, such as LUREX, the ankle loop 22 can be expanded enough to slip over a bare foot 24 of the wearer and around his or her ankle 26 (see FIG. 1). When the foot jewelry 10 is applied to the foot 24, the connecting bridge 18 stretches across the wearer's instep 28 and attaches the toe loop 12 to the ankle loop 22 (see FIG. 1).

Due to its elastic construction, the foot jewelry 10 expands and contracts so that it can be applied to feet of many different sizes and shapes. The stretchability of the foot jewelry 10 also provides it with the versatility of being attached between the ankle 26 and the toe 14 or between the ankle 26 and one or more of the other toes on the foot 24.

Figure 3:
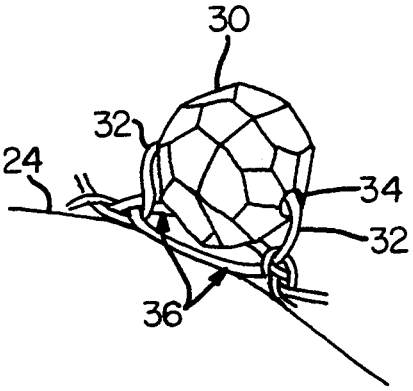
FIG. 3 is an enlarged view of a section of the foot jewelry of FIG. 1.

Referring still to FIGS. 1 and 2, multi-faceted beads 30 are applied to the connecting bridge 18 and the ankle loop 22 using a crocheting technique to be discussed in greater detail below. More particularly and with reference to FIG. 3, each of the beads 30 is positively located on the foot jewelry 10 by passing a strand of yarn 32 through a hole 34 in the center of the bead 30. The strand 32 is looped to one side of the bead 30 so that it functions as a double cushion 36 between the bead 30 and the foot 24 of the wearer. Because the bead 30 is not in direct contact with the foot 24 of the wearer, the ridges formed by its multi-faceted design do not cause discomfort to the wearer. While the beads 30 are inhibited from sliding, they are freely rotatable so that they can roll along the wearer's skin during and after the application of the foot jewelry 10, thereby further enhancing wearer comfort.

Figure 4:
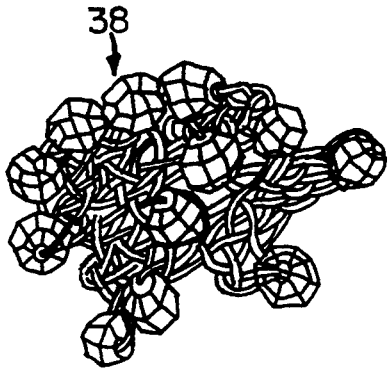
FIG. 4 is an elevational view of the foot jewelry of FIG. 1, the foot jewelry being shown in FIG. 4 in an unexpanded state when it is not applied to a wearer's foot.

Referring to FIG. 4, before or after its application to a wearer's foot, the foot jewelry 10 can be scrunched into a ball-like mass 38, which is compact enough to fit into a palm of a hand. When the foot jewelry 10 is scrunched into the ball-like mass 38, storage and shipping are facilitated.

It will be understood that the embodiment described herein is merely exemplary and that a person skilled in the art may make many variations and modifications without departing from the spirit and scope of the invention. For instance, other forms of beads, such as smooth pearls, can be used instead of multi-faceted beads. Also, while the crocheting technique disclosed herein may be carried out using a single strand of elastic yarn, other crocheting or knitting techniques may be employed which would necessitate the use of multiple strands. Thus, all such variations and modifications are intended to be included within the scope of the invention as defined in the appended claims.

I claim:

1. An article of foot jewelry comprising first attaching means for attaching said foot jewelry to a wearer's ankle; second attaching means for attaching said foot jewelry to a wearer's toe; third attaching means for attaching said first attaching means to said second attaching means; at least one decorative bead affixed to at least one of said attaching means by at least one strand of elastic yarn which passes through said at least one decorative bead; and cushioning means for providing a cushion between said at least one decorative bead and a wearer's foot, said cushioning means including a portion of said at least one strand of elastic yarn which extends alongside said at least one decorative bead, and said portion of said at least one strand of elastic yarn being looped to thereby enhance its cushioning effect.

2. An article of foot jewelry according to claim 1, wherein said looped portion of said at least one strand of elastic yarn includes a first leg extending adjacent to a first peripheral surface of said at least one decorative bead and a second leg extending adjacent to a second peripheral surface of said at least one decorative bead, said first and second legs being substantially parallel to each other, whereby said at least one decorative bead is cradled by said looped portion of said at least one strand of elastic yarn.

3. An article of foot jewelry according to claim 1, wherein said first attaching means is elastically expandable and contractible.

4. An article of foot jewelry according to claim 3, wherein said second attaching means is elastically expandable and contractible.

5. An article of foot jewelry according to claim 4, wherein said third attaching means is elastically expandable and contractible.

6. An article of foot jewelry according to claim 5, wherein said article of foot jewelry is elastically expandable and contractible such that, when expanded, said article of foot jewelry is sized and shaped so as to fit a wearer's foot and, when contracted, said article of foot jewelry becomes a ball-like mass sized and shaped so as to fit into a palm of a hand.

7. An article of foot jewelry according to claim 3, wherein said third attaching means is elastically expandable and contractible.

8. An article of foot jewelry according to claim 1, wherein said second attaching means is elastically expandable anti contractible.

9. An article of foot jewelry according to claim 8, wherein said third attaching means is elastically expandable and contractible.

10. An article of foot jewelry according to claim 1, wherein said third attaching means is elastically expandable and contractible.

11. An article of foot jewelry according to claim 1, wherein each decorative bead is multi-faceted.

12. An article of foot jewelry according to claim 1, wherein each decorative bead includes a hole extending therethrough and wherein said at least one strand of elastic yarn passes through said hole.

13. An article of foot jewelry, comprising first attaching means for attaching said foot jewelry to a wearer's ankle; second attaching means for attaching said foot jewelry to a wearer's toe; third attaching means for attaching said first attaching means to said second attaching means; a plurality of decorative beads affixed to at least one of said attaching means by at least one strand of elastic yarn which passes through said decorative beads; and cushioning means for providing a cushion between said decorative beads and a wearer's foot, said cushioning means including at least one strand of elastic yarn which extends alongside each of said decorative beads, and said cushioning means including a plurality of looped portions of said at least one strand of elastic yarn, each of said decorative beads being cushioned by a corresponding one of said looped portions.

14. An article of foot jewelry according to claim wherein some of said decorative beads are affixed to said first attaching means and some of said decorative beads are affixed to said third attaching means.

15. An article of foot jewelry, comprising first attaching means for attaching said foot jewelry to a wearer's ankle; second attaching means for attaching said foot jewelry to a wearer's toe; third attaching means for attaching said first attaching means to said second attaching means; at least one decorative bead affixed to at least one of said attaching means by at least one strand of elastic yarn which passes through said at least one decorative bead; and cushioning means for providing a cushion between said at least one decorative bead and a wearer's foot, said cushioning means including a portion of said at least one strand of elastic yarn which extends alongside said at least one decorative bead, and said first, second and third attaching means being crocheted from said at least one strang of elastic yarn.

16. An article of foot jewelry according to claim wherein said first attaching means is in the form of a first closed loop made from said at least one strand of elastic yarn and wherein said second attaching means is in the form of a second closed loop made from said at least one strand of elastic yarn, said second closed looped being smaller than said first closed loop.

17. An article of foot jewelry according to claim 16, wherein said first closed loop is sized and shaped so a to fit a wearer's ankle, said second closed loop is sized and shaped so as to fit a wearer's toe, and said third attaching means includes a connecting bridge extending across a wearer's instep when said first closed loop is applied to a wearer's ankle and said second closed loop is applied to a wearer's toe.

18. An article of foot jewelry according to claim wherein each decorative bead is rotatably affixed to said at least one strand of elastic yarn.

19. An article of foot jewelry according to claim 18, wherein each decorative bead includes a hole extending therethrough and wherein said at least one strand of elastic yarn passes through said hole.

* * * * *